US009789722B2

(12) United States Patent
Nagoshi et al.

(10) Patent No.: US 9,789,722 B2
(45) Date of Patent: Oct. 17, 2017

(54) PRINTING COATED PAPER AND METHOD FOR PRODUCING A PRINTED MATERIAL USING THE SAME

(71) Applicant: MITSUBISHI PAPER MILLS LIMITED, Tokyo (JP)

(72) Inventors: Masanori Nagoshi, Tokyo (JP); Koji Idei, Tokyo (JP); Tetsuya Nishi, Tokyo (JP); Toru Kaneko, Tokyo (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 137 days.

(21) Appl. No.: 14/373,125

(22) PCT Filed: Jan. 15, 2013

(86) PCT No.: PCT/JP2013/050578

§ 371 (c)(1),
(2) Date: Jul. 18, 2014

(87) PCT Pub. No.: WO2013/108753

PCT Pub. Date: Jul. 25, 2013

(65) Prior Publication Data

US 2014/0363581 A1 Dec. 11, 2014

(30) Foreign Application Priority Data

Jan. 20, 2012 (JP) ..... 2012-009558
Feb. 29, 2012 (JP) ..... 2012-043559

(51) Int. Cl.

| | |
|---|---|
| ***B41M 5/52*** | (2006.01) |
| ***D21H 23/56*** | (2006.01) |
| ***D21H 17/44*** | (2006.01) |
| ***D21H 17/66*** | (2006.01) |
| ***D21H 17/00*** | (2006.01) |
| ***D21H 19/38*** | (2006.01) |
| ***D21H 19/72*** | (2006.01) |
| ***D21H 21/16*** | (2006.01) |
| ***D21H 21/52*** | (2006.01) |
| ***B41M 5/50*** | (2006.01) |
| ***B05D 1/02*** | (2006.01) |
| ***B41M 5/41*** | (2006.01) |

(52) U.S. Cl.

CPC ..... *B41M 5/5218* (2013.01); *B05D 1/02* (2013.01); *B41M 5/41* (2013.01); *B41M 5/508* (2013.01); *D21H 17/44* (2013.01); *D21H 17/66* (2013.01); *D21H 17/74* (2013.01); *D21H 19/385* (2013.01); *D21H 19/72* (2013.01); *D21H 21/16* (2013.01); *D21H 21/52* (2013.01); *D21H 23/56* (2013.01); *B41M 2205/32* (2013.01)

(58) Field of Classification Search
None
See application file for complete search history.

(56) References Cited

U.S. PATENT DOCUMENTS

| | | | |
|---|---|---|---|
| 2012/0107531 | A1 | 5/2012 | Idei et al. |
| 2012/0114880 | A1 | 5/2012 | Nagoshi et al. |

FOREIGN PATENT DOCUMENTS

| | | | | |
|---|---|---|---|---|
| JP | 2002-234247 | A | | 8/2002 |
| JP | 2004-237650 | A | | 8/2004 |
| JP | 2009-023292 | A | | 2/2009 |
| JP | 2010-100039 | A | | 5/2010 |
| JP | WO2011001955 | | * | 1/2011 |
| WO | WO 2011/001955 | A1 | | 5/2010 |
| WO | WO 2011/007775 | A1 | | 1/2011 |

* cited by examiner

*Primary Examiner* — Nathan T Leong
(74) *Attorney, Agent, or Firm* — Birch, Stewart, Kolasch & Birch, LLP

(57) ABSTRACT

Provided is a printing coated paper which is advantageous not only in that the coated paper has offset printability and causes no mottling in the printed area even in ink jet printing, but also in that the coated paper exhibits excellent rubbing resistance with respect to the printed area and excellent print density of a dye ink. The task of the present invention is achieved by a printing coated paper having a coating layer comprised mainly of a pigment and a binder formed on at least one side of a base paper, wherein the base paper is a treated base paper which has been subjected to size press using a treatment solution containing at least one member selected from a cationic resin and a water-soluble multivalent cation salt, wherein the total applied amount per each side of the at least one member selected from a cationic resin and a water-soluble multivalent cation salt, in terms of the solids content, is in the range of from 0.1 to 5.0 g/m$^2$, and wherein the at least one pigment in the coating layer is ground calcium carbonate having an average particle diameter of 0.1 to 0.28 μm, wherein the amount of the ground calcium carbonate having an average particle diameter of 0.1 to 0.28 μm contained in the coating layer is in the range of 60 parts by mass or more, relative to 100 parts by mass of the total of the pigment(s) in the coating layer.

2 Claims, No Drawings

PRINTING COATED PAPER AND METHOD FOR PRODUCING A PRINTED MATERIAL USING THE SAME

FIELD OF THE INVENTION

The present invention relates to a printing coated paper which has offset printability and which is advantageously used in an ink-jet printing machine used in the field of commercial printing. In addition, the present invention is also concerned with a method for producing a printed material using the printing coated paper by means of an ink-jet printing machine.

BACKGROUND ART

In recent years, the ink-jet recording system is increased in speed and size, and commercial printing utilizing the ink-jet recording system (hereinafter, referred to as "ink-jet printing") has been started. An industrial printing machine using the ink-jet recording system for use in the commercial printing (hereinafter, referred to as "ink-jet printing machine") has already been developed (see, for example, patent document 1). In the field of commercial printing, the number of copies printed is large, and, in view of a balance between the productivity and the printing cost, the printing speed is very important, and an ink-jet printing machine having a printing speed of 15 m/minute or more, or having a higher printing speed of 60 in/minute or more, has been developed. Further, an ink-jet printing machine of a rotary press system having mounted a pigment ink, having a further higher printing speed of more than 120 m/minute, has been developed.

The ink-jet printing machine can deal with variable information, and therefore is applied particularly to on-demand printing. In the commercial printing, a preferred mode is such that printing for fixed information is made using an offset printing machine and printing for variable information is made using an ink jet printing machine.

As an ink-jet recording paper having appearance as excellent as that of a coated paper for use in offset printing and having printability to an ink jet printer, an ink-jet recording paper having a coating layer comprised mainly of an inorganic pigment and a binder formed on at least one side of a substrate is disclosed, wherein, relative to 100 parts by mass of the total of the inorganic contents of the coating layer, more than 95 parts by mass of any one of ground calcium carbonate, precipitated calcium carbonate, and kaolin or a mixture of two or more of these pigments is contained as an inorganic content, wherein the pigment collectively has an average particle diameter in the range of from 0.02 to 2.00 μm (see, for example, patent document 2).

Ground calcium carbonate for use in an ink-jet recording sheet is disclosed, wherein the ground calcium carbonate contains ground calcium carbonate having a particle diameter of 0.1 to 1 μm in an amount of 80% by mass or more and has an average particle diameter of 0.2 to 0.4 μm (see, for example, patent document 3).

PRIOR ART REFERENCES

Patent Documents

Patent document 1: Japanese Patent Application Laid-Open No. 2009-23292

Patent document 2: Japanese Patent Application Laid-Open No. 2010-100039

Patent document 3: Japanese Patent Application Laid-Open No. 2002-234247

DISCLOSURE OF THE INVENTION

Problems to be Solved by the Invention

When a conventional offset printing coated paper is used in the ink-jet printing machine, the surface of the coated paper is unsatisfactory in the affinity with the ink used in the ink-jet printing machine, or the coated paper is unsatisfactory in the ink absorption, causing a problem in that mottling (mark of extremely small spots) occurs in the solid portion or shadow portion of the printed image area in the range of the printing speed for commercial printing. Particularly, when the surface of the coated paper is unsatisfactory in the affinity with the ink, even though the coated paper has satisfactory ink absorption, it is likely that the ink drops applied to the surface of the coated paper are repelled immediately they are put on the surface, and form a mark of spots together with the ink drops around them, that is, the ink drops cause mottling. Further, when the printing is performed using a dye ink, the print density of the dye ink is markedly poor. In addition, the rubbing resistance with respect to the printed area, e.g., the solid portion or shadow portion is poor.

In the ink-jet recording system, for improving the ink absorption, for example, there are a method in which the amount of the binder used in the coating layer is reduced and a method in which a large amount of a porous pigment is used in the coating layer. However, in these methods, the coating layer is reduced in the layer strength of the coating layer, so that the offset printability becomes poor, for example, blanket piling occurs during the offset printing.

The ink-jet recording paper and ink-jet recording sheet disclosed in patent documents 2 and 3 are likely to be unsatisfactory in the printability to the ink-jet printing machine which is being further increased in the printing speed, unsatisfactory especially in the suppression of the occurrence of mottling. Further, with respect to these ink-jet recording paper and ink-jet recording sheet, satisfactory studies have not been made on the offset printing and the ink-jet printing machine having a printing speed of 15 m/minute or more, or having a printing speed of 60 m/minute or more which is further preferred in the commercial printing.

It is an object of the present invention to provide a printing coated paper which is advantageous in that (1) the coated paper has offset printability, that (2) the coated paper satisfactorily suppresses the occurrence of mottling in the printed image area in ink-jet printing, that (3) the coated paper exhibits excellent print density in ink jet printing using a dye ink, and that (4) the coated paper exhibits excellent rubbing resistance with respect to the printed area in ink jet printing. It is another object of the present invention to provide a method for producing a printed material by means of an ink jet printing machine using the above-mentioned printing coated paper, which method is advantageous in that the produced printed material can be a commercial printed material such that the occurrence of mottling is suppressed and the print density of a dye ink and the rubbing resistance with respect to the printed area are excellent.

Means to Solve the Problems

The above-mentioned problems can be solved by a printing coated paper having a coating layer comprised mainly of a pigment and a binder formed on at least one side of a base paper, wherein the base paper is a treated base paper which has been subjected to size press using a treatment solution containing at least one member selected from a cationic resin and a water-soluble multivalent cation salt, wherein the total applied amount per each side of the at least one member selected from a cationic resin and a water-soluble multivalent cation salt, in terms of the solids content, is in the range of from 0.1 to 5.0 g/m$^2$, and wherein the at least one pigment in the coating layer is ground calcium carbonate having an average particle diameter in the range of from 0.1 to 0.28 μm, wherein the amount of the ground calcium carbonate having an average particle diameter in the range of from 0.1 to 0.28 μm contained in the coating layer is in the range of 60 parts by mass or more, relative to 100 parts by mass of the total of the pigment(s) in the coating layer.

The printing coated paper of the present invention is advantageous not only in that the coated paper has excellent offset printability and suppresses the occurrence of mottling in the printed image area in ink-jet printing, but also in that the coated paper exhibits excellent print density of a dye ink and excellent rubbing resistance with respect to the printed area in ink-jet printing.

Further, the above-mentioned problems can be solved by a method for producing a printed material, which comprises producing a printed material by means of an ink-jet printing machine having a printing speed of 60 m/minute or more using a printing coated paper having a coating layer comprised mainly of a pigment and a binder formed on at least one side of a base paper, wherein the base paper is a treated base paper which has been subjected to size press using a treatment solution containing at least one member selected from a cationic resin and a water-soluble multivalent cation salt, wherein the total applied amount per each side of the at least one member selected from a cationic resin and a water-soluble multivalent cation salt, in terms of the solids content, is in the range of from 0.1 to 5.0 g/m$^2$, and wherein the at least one pigment in the coating layer is ground calcium carbonate having an average particle diameter in the range of from 0.1 to 0.28 μm, wherein the amount of the ground calcium carbonate having an average particle diameter in the range of from 0.1 to 0.28 μm contained in the coating layer is in the range of 60 parts by mass or more, relative to 100 parts by mass of the total of the pigment(s) in the coating layer.

By the method for producing a printed material of the present invention, a printed material, which can be a commercial printed material advantageous in that the occurrence of mottling is suppressed and the print density of a dye ink and the rubbing resistance with respect to the printed area are excellent, can be produced by means of an ink jet printing machine.

Mode for Carrying Out the Invention

In the present specification, the term "ink-jet printing machine" means an industrial printing machine for use in commercial printing utilizing an ink jet recording system. Examples of such printing machines include an ink-jet printing machine having a printing speed of 15 in/minute or more, or having a higher printing speed of 60 m/minute or more, or a further higher printing speed of more than 75 in/minute, and an ink-jet printing machine of a rotary press system having mounted a pigment ink or a dye ink. In the present specification, the "ink-jet printing machine" is distinguished from a printer utilizing an ink-jet recording system having a printing speed of several m/minute (hereinafter, referred to as "ink-jet printer") including a household narrow-format printer and a large-format printer used by, e.g., printing business persons. In the present specification, the term "ink-jet printing" means commercial printing utilizing an ink-jet recording system, in which the printing is performed using an ink-jet printing machine.

The offset printing is an indirect printing system in which an ink is first transferred to a blanket and then further transferred to a material to be printed. Excellent offset printability means that, for example, blanket piling is not caused after the offset printing.

Hereinbelow, the printing coated paper of the present invention will be described in detail.

The base paper used in the present invention is paper made by a conventionally known acidic, neutral, or alkaline method from a stock which contains cellulose pulp selected from chemical pulp, such as LBKP (Leaf Bleached Kraft Pulp) and NBKP (Needle Bleached Kraft Pulp), mechanical pulp, such as GP (Groundwood Pulp), PGW (Pressure GroundWood pulp), RMP (Refiner Mechanical Pulp), TMP (ThermoMechanical Pulp), CTMP (ChemiThermoMechanical Pulp), CMP (ChemiMechanical Pulp), and CGP (ChemiGroundwood Pulp), and recycled pulp, such as DIP (DeInked Pulp) (these pulp may be used individually or in combination), a filler, such as precipitated calcium carbonate, ground calcium carbonate, talc, clay, or kaolin, and further, if necessary, an additive, such as a sizing agent, a fixing agent, a retention aid, or a cationic agent.

In the present invention, in the stock, another appropriate additive, such as a pigment dispersant, a thickener, a fluidity-improving agent, a defoamer, an antifoamer, a release agent, a foaming agent, a penetrating agent, a coloring dye, a coloring pigment, a optical brightener, an ultraviolet light absorber, an antioxidant, an antiseptic agent, a fungicide, a water resistant agent, a wet strength agent, or a dry strength agent, can be incorporated in such an amount that the desired effects of the present invention are not sacrificed.

In the present invention, from the viewpoint of achieving excellent ink absorption in the ink-jet recording system, the ash content of the base paper is preferably in the range of from 8 to 25% by mass, more preferably in the range of from 10 to 20% by mass.

The term "ash content" used here means a ratio (% by mass) of the mass of the non-combustible material, which is obtained by subjecting the base paper to burning treatment at 500° C. for one hour, to the oven dry mass of the base paper before the burning treatment. The ash content of the base paper can be controlled by appropriately changing the content of, e.g., a filler in the base paper.

In the present invention, with respect to the thickness of the base paper, there is no particular limitation, but the thickness of the base paper is preferably in the range of from 50 to 300 μm, further preferably in the range of from 80 to 250 μm.

In the present invention, with respect to the degree of sizing of the base paper, any degree of sizing may be employed as long as the desired effects of the present invention are not sacrificed, and the degree of sizing paper can be controlled by appropriately changing the amount of the internal sizing agent or the amount of the surface sizing agent applied to the base paper. Examples of internal sizing agents include a rosin sizing agent for acid paper, and sizing agents for alkaline paper, such as alkenyl succinic anhydride, an alkyl ketene dimer, a neutral rosin sizing agent, and a cationic styrene-acryl sizing agent. Examples of surface sizing agents include a styrene-acryl sizing agent, an olefin sizing agent, and a styrene-maleic sizing agent.

In the present invention, the base paper is a treated base paper which has been subjected to size press using a treatment solution containing at least one member selected from a cationic resin and a water-soluble multivalent cation salt. By virtue of using the treated base paper, there can be obtained a printing coated paper which suppresses the occurrence of mottling in the printed image area in ink-jet printing and which exhibits excellent print density of a dye ink and excellent rubbing resistance with respect to the printed area in ink-jet printing.

In the present invention, the cationic resin is a cationic polymer or cationic oligomer generally used, and, with respect to the type of the cationic resin, there is no particular limitation. A preferred cationic resin is a polymer or oligomer containing a primary, secondary, or tertiary amine, or a quaternary ammonium salt, with which a proton is likely to coordinate, and which is dissolved in water to dissociate and exhibit cationic properties. Specific examples of cationic resins include compounds, such as polyethylenimine, polyvinylpyridine, polyaminesulfone, polydialkylaminoethyl methacrylate, polydialkylaminoethyl acrylate, polydialkylaminoethylmethacrylamide, polydialkylaminoethylacrylamide, polyepoxyamine, polyamidoamine, a dicyandiamide-formalin condensation product, polyvinylamine, and polyallylamine, and hydrochlorides thereof, further, polydiallyldimethylammonium chloride, a copolymers of diallyldimethylammonium chloride and acrylamide and the like, polydiallylmethylamine hydrochloride, and a dimethylamine-epichlorohydrin condensation product, but the cationic resin is not limited to these compounds. As a preferred example of the cationic resin, there can be mentioned a dimethylamine-epichlorohydrin condensation product. In the present invention, with respect to the average molecular weight of the cationic resin, there is no particular limitation, but the average molecular weight is preferably in the range of from 500 to 20,000, more preferably in the range of from 1,000 to 10,000.

In the present invention, the water-soluble multivalent cation salt is a salt capable of being dissolved in water at 20° C. in an amount of 1% by mass or more, comprising multivalent cations. Examples of multivalent cations include bivalent cations, such as magnesium, calcium, strontium, barium, nickel, zinc, copper, iron, cobalt, tin, and manganese; trivalent cations, such as aluminum, iron, and chromium; tetravalent cations, such as titanium and zirconium; and complex ions thereof. Anions which form a salt together with the multivalent cations may be any of an inorganic acid and an organic acid, and are not particularly limited. Examples of inorganic acids include hydrochloric acid, nitric acid, phosphoric acid, sulfuric acid, boric acid, and hydrofluoric acid, but the inorganic acid is not limited to these acids. Examples of organic acids include formic acid, acetic acid, lactic acid, citric acid, oxalic acid, succinic acid, and organic sulfonic acid, but the organic acid is not limited to these acids.

Preferred water-soluble multivalent cation salts are calcium salts, such as calcium chloride, calcium formate, calcium nitrate, and calcium acetate. The reason that calcium salts are preferred resides in that the layer strength of the coating layer is not reduced, preventing the offset printability from becoming poor. Further, when using a pigment ink as an ink for the ink-jet printing machine, from the viewpoint of obtaining a rubbing resistance with respect to the printed image area, calcium chloride and calcium nitrate are preferred.

In the present invention, the treatment solution containing at least one member selected from a cationic resin and a water-soluble multivalent cation salt can contain the above-mentioned surface sizing agent.

In the present invention, the treated base paper is obtained by size press using the treatment solution containing at least one member selected from a cationic resin and a water-soluble multivalent cation salt. The system of the size press is a conventionally known system, and examples of the systems include an inclined size press, a horizontal size press, and film transfer systems, such as a rod metering size press, a roll metering size press, and a blade metering size press. Examples of rod metering size presses include a symsizer, an optisizer, a speed sizer, and a film press, and examples of roll metering size presses include a gate roll coater. Other examples include a bill blade coater, a twin blade coater, a belbapa coater, a tab size press, and a calender size press. Preferred are an inclined size press, a horizontal size press, a gate roll coater, a symsizer, and a film press. Another coating system, such as a curtain coater or an air-knife coater, may be used, but, from the fact that at least member one selected from a cationic resin and a water-soluble multivalent cation salt is present on the surface of the base paper in a relatively large amount and from the viewpoint of the productivity and production cost, a size press is preferred.

In the present invention, the total applied amount per each side of the at least one member selected from a cationic resin and a water-soluble multivalent cation salt, in terms of the solids content, is in the range of from 0.1 to 5.0 g/m$^2$. The term "total applied amount" means the applied amount per each side of the total of the at least one substance selected from a cationic resin and a water-soluble multivalent cation salt. When the total applied amount is smaller than the above range, the occurrence of mottling is not satisfactorily suppressed, or the print density of a dye ink in ink-jet printing becomes unsatisfactory. On the other hand, when the total applied amount is larger than the above range, it is likely that the occurrence of mottling is not satisfactorily suppressed, the offset printability becomes poor, or the print density of a dye ink in ink-jet printing becomes poor.

In the present invention, the printing coated paper has, on the treated base paper, a coating layer comprised mainly of a pigment and a binder. The expression used here that the coating layer is "comprised mainly of a pigment and a binder" means that the total of the pigment and the binder constitutes the largest proportion of the coating weight of the coating layer, in terms of the solids content.

In the present invention, the at least one pigment in the coating layer is ground calcium carbonate having an average particle diameter of 0.1 to 0.28 μm. The printing coated paper having a combination of the treated base paper, which has been subjected to size press using a treatment solution containing at least one member selected from a cationic resin and a water-soluble multivalent cation salt, and the coating layer containing the ground calcium carbonate having the average particle diameter in the present invention has offset printability and can suppress the occurrence of mottling in ink-jet printing. Further, the printing coated paper can achieve a rubbing resistance with respect to the printed area. In addition, the printing coated paper can improve the print density when using a dye ink as an ink for the ink jet printing machine. In the ink-jet printing machine having an increased printing speed, the reduction of the ground calcium carbonate in particle diameter, which is considered to negatively affect the ink absorption of the coating layer, rather improves the ink-jet printability and suppresses the occurrence of mottling, and this is an unexpected effect. Further, when using a dye ink having a coloring material dissolved in a solvent, for achieving print density of the dye ink, the coating layer is required to be highly transparent. The reduction of the ground calcium carbonate in particle diameter can improve the coating layer in transparency, so that the print density of a dye ink can be improved.

In the present invention, the ground calcium carbonate has an average particle diameter in the range of from 0.1 to 0.28 μm. When the average particle diameter of the ground calcium carbonate falls outside of the above range, mottling may occur in the printed image area with respect to the ink used in the inkjet printing machine or the ink absorption may become unsatisfactory to cause staining in the printed image area. When the average particle diameter is larger than the above range, the print density of a dye ink in inkjet printing may become poor.

The ground calcium carbonate having the above-mentioned average particle diameter can be produced by, for example, the method described below. Natural limestone is first dry-milled, and the resultant powder is dispersed in water or an aqueous solution having added a dispersant to prepare a ground calcium carbonate pre-dispersed slurry. Further, the thus prepared ground calcium carbonate pre-dispersed slurry is wet-milled using, for example, a bead mill. The natural limestone can be directly wet-milled, but it is preferred that, prior to wet milling, the natural limestone is dry-milled. In the dry milling, the limestone is preferably milled so that the resultant limestone has a particle diameter of 40 mm or less, preferably has an average particle diameter of about 2 μm to 2 mm.

Then, the surface of the milled limestone is preferably treated with an organic dispersant. This can be made by various methods, and a method is preferred in which the dry-milled limestone is wet-milled in the presence of an organic dispersant. Specifically, an aqueous medium is added to the limestone so that the limestone/aqueous medium (preferably water) mass ratio becomes in the range of from 30/70 to 85/15, preferably in the range of from 60/40 to 80/20, and an organic dispersant is added to the resultant mixture. With respect to the amount of the organic dispersant used, there is no particular limitation, but the amount of the organic dispersant used is, relative to 100 parts by mass of the ground calcium carbonate, in terms of the solids content, preferably in the range of from 0.3 to 3.5 parts by mass, more preferably in the range of from 0.5 to 3 parts by mass. The resultant dispersion is wet-milled by a conventionally known method. Alternatively, an aqueous medium having preliminarily dissolved therein an organic dispersant in an amount in the above range is mixed with the limestone and wet-milled by a conventionally known method. The wet milling may be performed in any of a batchwise manner and a continuous manner and an apparatus, e.g., a mill using a grinding medium, such as a sand mill, an attritor, or a ball mill, is preferably used. By performing the wet milling, the ground calcium carbonate having an average particle diameter of 0.1 to 0.28 μm can be obtained. The method for obtaining the ground calcium carbonate having the average particle diameter in the present invention is not limited to the above-mentioned method.

Examples of the organic dispersants include water-soluble anionic surfactants and water-soluble nonionic surfactants. Examples of water-soluble anionic surfactants include low molecular-weight or polymer surfactants having as a functional group a carbonate, a sulfate salt, a sulfonate, or a phosphate salt. Examples of low molecular-weight carbonates include higher fatty acid salts, such as sodium laurate, sodium stearate, and sodium oleate, higher alcohol ethylene oxide acetate salts, and perfluoroalkylcarboxylic acid salts. Examples of polymer carbonates include a polyacrylic acid salt, a salt of a copolymer comprising one or at least two or more carboxylic acid monomers, such as an acrylic acid-maleic acid copolymer, a salt of a copolymer comprising a vinyl compound and a carboxylic acid monomer, and carboxymethyl cellulose having a carboxyl group which forms a salt. Examples of sulfate salts include a higher alcohol ethylene oxide sulfate salt, a sulfated oil, a sulfated fatty acid ester salt, a sulfated fatty acid salt, a sulfated olefin, and an alkylphenol polyethylene oxide sulfate salt.

Examples of low molecular-weight sulfonates include alkylbenzenesulfonates, α-olefinsulfonates, and perfluoroalkylsulfonates, and examples of polymer sulfonates include a formalin condensation product of a naphthalenesulfonate, polystyrenesulfonate, polyvinylsulfonate, polyarylsulfonate, and salts of a copolymer of acrylamide and acrylamidopropanesulfonic acid. For example, copolymer-type polymer surfactants, which are salts of a copolymer comprising a carboxylic acid monomer and a sulfonic acid monomer, are also included. Examples of phosphate salts include higher alcohol monophosphate salts, higher alcohol ethylene oxide phosphate salts, and alkylphenol polyethylene oxide phosphate salts.

Of these water-soluble anionic surfactants, for obtaining a high-concentration slurry by wet milling, polymer surfactants are preferred, and especially preferred examples include a polyacrylic acid salt and a salt of a copolymer comprising one or at least two or more carboxylic acid monomers, such as a salt of an acrylic acid-maleic acid copolymer. With respect to the molecular weight of these surfactants, there is no particular limitation, but the molecular weight is preferably 1,000 to 100,000, more preferably 5,000 to 50,000.

Examples of water-soluble nonionic surfactants used as an organic dispersant include polyethylene glycol nonionic surfactants and polyhydric alcohol nonionic surfactants. Examples of polyethylene glycol nonionic surfactants include a higher alcohol ethylene oxide addition product, an alkylphenol ethylene oxide addition product, a fatty acid ethylene oxide addition product, a polyhydric alcohol fatty acid ester ethylene oxide addition product, a fatty acid amide ethylene oxide addition product, a polypropylene glycol ethylene oxide addition product, and polyether-modified silicone.

Examples of polyhydric alcohol nonionic surfactants include a glycerol fatty acid ester, a pentaerythritol fatty acid ester, a sorbitol or sorbitan fatty acid ester, a sucrose fatty acid ester, a polyhydric alcohol alkyl ether, a polyglycerol fatty acid ester and an ethylene oxide addition product thereof, and an alkanolamine fatty acid amide, and further include methyl cellulose, hydroxyethyl cellulose, polyvinyl alcohol, a polyalkylene oxide vinyl ether compound, and polyhydroxyalkyl (meth)acrylate. Of these water-soluble nonionic surfactants, for obtaining a high-concentration slurry by wet milling, polymer water-soluble nonionic surfactants are preferred, and more preferred are, for example, low polymerization-degree, partially saponified polyvinyl alcohol and polyhydroxyalkyl (meth)acrylate.

Among the above-mentioned various organic dispersants, polyacrylic acid organic dispersants having polyacrylic acid are especially preferred. These organic dispersants are commercially available from, for example, SAN NOPCO LIMITED, Toagosei Co., Ltd., and Kao Corporation, and can be used in the present invention.

In the present invention, the average particle diameter is an average particle diameter based on particle size distribution measurement, in terms of the volume, using a laser diffraction-scattering method or a dynamic light scattering method. The average particle diameter can be measured using, for example, a laser diffraction-scattering-type particle size distribution measurement apparatus, Microtrac MT3300EXII, manufactured by Nikkiso Co., Ltd. The average particle diameter of, e.g., the ground calcium carbonate can be determined from the printing coated paper as follows. For example, using a scanning electron microscope, an electron photomicrograph of the surface of the printing coated paper is taken, and, from the resultant image, the ground calcium carbonate particles are regarded as spheres having cross-section areas approximately equal to the circular areas shown in the image, and particle diameters of the spheres are measured to determine an average particle diameter.

The coating layer in the present invention can contain a conventionally known pigment as a pigment other than the above-mentioned ground calcium carbonate. Examples of such pigments include inorganic pigments, such as kaolin, precipitated calcium carbonate, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, aluminum hydroxide, alumina, lithopone, zeolite, magnesium carbonate, and magnesium hydroxide; and organic pigments, such as a styrene plastic pigment, an acrylic plastic pigment, a styrene-acryl plastic pigment, polyethylene, a microcapsule, an urea resin, and a melamine resin.

In the present invention, from the viewpoint of suppressing the occurrence of mottling or achieving the print density of a dye ink the amount of the ground calcium carbonate contained in the coating layer is 60 parts by mass or more, relative to 100 parts by mass of the total of the pigment(s) in the coating layer. When the amount of the ground calcium carbonate is less than 60 parts by mass, the occurrence of mottling cannot be suppressed, and further the print density of a dye ink becomes poor. Further, when the amount of the ground calcium carbonate is less than 60 parts by mass, the offset printability may become poor.

In the present invention, the binder is a conventionally known binder. Examples of binders include polyacrylic acid polymers, such as sodium polyacrylate and polyacrylamide, polyvinyl acetate polymers, various copolymers, such as a styrene-butadiene copolymer and an ethylene-vinyl acetate, polyvinyl alcohol, modified polyvinyl alcohol, polyethylene oxide, formalin resins, such as urea and melamine, and water-soluble synthetic materials, such as epichlorohydrin. Further examples of binders include starch obtained by refining from natural plants, hydroxyethylated starch, oxidized starch, etherified starch, starch phosphate, enzyme-modified starch, cold water-soluble starch obtained by flash drying the above starch, and natural polysaccharides, such as dextrin, mannan, chitosan, arabinogalactan, glycogen, inulin, pectin, hyaluronic acid, carboxymethyl cellulose, and hydroxyethyl cellulose, and oligomers thereof and modification products thereof. Further, examples of binders include natural proteins, such as casein, gelatin, soybean protein, and collagen, and modification products thereof, and synthetic polymers and oligomers, such as polylactic acid and peptides. These can be used individually or in combination. A binder which is cationically modified can be used. When an excess of the binder is incorporated to the pigment, the ink absorption in ink jet printing may become poor to cause staining in the printed image area. Therefore, the amount of the binder is, relative to 100 parts by mass of the total of the pigment(s) contained in the coating layer, in terms of the solids content, preferably in the range of from 3 to 30 parts by mass, more preferably in the range of from 5 to 20 parts by mass.

In the coating layer in the present invention, in addition to the pigment and binder, another appropriate additive, such as an ink fixing agent, a pigment dispersant, a thickener, a fluidity-improving agent, a printability-improving agent, a surfactant, a defoamer, an antifoamer, a release agent, a foaming agent, a penetrating agent, a coloring dye, a coloring pigment, an optical brightener, an ultraviolet light absorber, an antioxidant, an antiseptic agent, a fungicide, a water resistant agent, a wet strength agent, or a dry strength agent, can be incorporated.

In the present invention, the printing coated paper can be obtained by applying a coating composition for coating layer onto the treated base paper and drying the applied coating composition. With respect to the method for applying a coating composition for coating layer onto the treated base paper, a coating apparatus generally used can be used, and there is no particular limitation. For example, various types of a roll coater, an air-knife coater, a bar coater, and blade coaters, such as a rod blade coater, and various coating apparatuses, such as a short dwell coater and a curtain coater, can be used. As a drying method, a drying apparatus generally used can be used, and there is no particular limitation. Examples of drying apparatuses include hot-air dryers, such as a linear tunnel dryer, an arch dryer, an air-loop dryer, and a sine curve air-floating dryer, and various drying apparatuses, such as an infrared or heating dryer, and a dryer utilizing, e.g., a microwave.

In the present invention, the coating weight of the coating layer per each side is preferably 8.0 to 20.0 g/m$^2$. When the coating weight is in this range, both the offset printability and the ink-jet printability can be obtained. In the present invention, the coating weight of the coating layer indicates the coating weight in terms of the dry solids content.

After the application, the resultant printing coated paper can be used as such, but, if necessary, the surface of the coated paper can be smoothed by, for example, machine calendering, soft-nip calendering, supercalendering, multi-stage calendering, or multi-nip calendering.

The calendering treatment performed to an excess extent for smoothing the surface collapses the voids of the printing coated paper, so that the ink absorption of the coated paper becomes poor in ink-jet printing. Therefore, an appropriate calendering treatment is preferred.

In the present invention, a coating composition for the coating layer may be applied to both sides of the base paper. When the coating layer is formed on the both sides, printing can be advantageously made on the both sides of the printing coated paper.

Further, the printing coated paper of the present invention can be used not only in offset printing but also in other printing systems, such as gravure printing and wet and dry electrophotographs, and the printing system is not limited. Further, the printing coated paper of the present invention can be used not only in an ink jet printing machine but also in, for example, a commercially available ink-jet printer.

By using the printing coated paper of the present invention, there can be provided a method for producing a printed material having excellent image quality for commercial printing using an inkjet printing machine having a printing speed of 15 m/minute or more, or having a higher printing speed of 60 m/minute or more, or a further higher printing speed of 75 m/minute or more. By using the printing coated paper of the present invention, there can be provided a method of forming an excellent printed image for commercial printing using an offset printing machine and an ink-jet printing machine.

EXAMPLES

Hereinbelow, the present invention will be described in more detail with reference to the following Examples, which should not be construed as limiting the scope of the present invention. In the following Examples, "part(s)" and "%" indicate part(s) by mass and % by mass, respectively, in terms of the dry solids content or the substantial components unless otherwise specified. Further, the amount of the application using a size press apparatus and the coating weight of the coating composition for coating layer are indicated in terms of the dry solids content.

(Preparation of a Treated Base Paper)

<Treated Base Paper 1>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and a dimethylamine-epichlorohydrin condensation product (Jetfix 36N, manufactured by Satoda Chemical Industrial Co., Ltd.) in an amount of 3.0 g/m$^2$ per each side using a size press apparatus, followed by machine calendering treatment, to prepare treated base paper 1 having a basis weight of 100 g/m$^2$.

<Treated Base Paper 2>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and a dimethylamine-epichlorohydrin condensation product (Jetfix 36N, manufactured by Satoda Chemical Industrial Co., Ltd.) in an amount of 0.1 g/m$^2$ per each side using a size press apparatus, followed by machine calendering treatment, to prepare treated base paper 2 having a basis weight of 100 g/m$^2$.

<Treated Base Paper 3>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and a dimethylamine-epichlorohydrin condensation product (Jetfix 36N, manufactured by Satoda Chemical Industrial Co., Ltd.) in an amount of 5.0 g/m$^2$ per each side using a size press apparatus, followed by machine calendering treatment, to prepare treated base paper 3 having a basis weight of 100 g/m$^2$.

<Treated Base Paper 4>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and a dimethylamine-epichlorohydrin condensation product (Jetfix 36N, manufactured by Satoda Chemical Industrial Co., Ltd.) in an amount of 0.05 g/m$^2$ per each side using a size press apparatus, followed by machine calendering treatment, to prepare treated base paper 4 having a basis weight of 100 g/m$^2$.

<Treated Base Paper 5>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and a dimethylamine-epichlorohydrin condensation product (Jetfix 36N, manufactured by Satoda Chemical Industrial Co., Ltd.) in an amount of 5.5 g/m$^2$ per each side using a size press apparatus, followed by machine calendering treatment, to prepare treated base paper 5 having a basis weight of 100 g/m$^2$.

<Treated Base Paper 6>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and calcium nitrate in an amount of 3.0 g/m$^2$ per each side using a size press apparatus, followed by machine calendering treatment, to prepare treated base paper 6 having a basis weight of 100 g/m$^2$.

<Treated Base Paper 7>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and calcium nitrate in an amount of 0.1 g/m$^2$ per each side using a size press apparatus, followed by machine calendering treatment, to prepare treated base paper 7 having a basis weight of 100 g/m$^2$.

<Treated Base Paper 8>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and calcium nitrate in an amount of 5.0 g/m$^2$ per each side using a size press apparatus, followed by machine calendering treatment, to prepare treated base paper 8 having a basis weight of 100 g/m$^2$.

<Treated Base Paper 9>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and calcium nitrate in an amount of 0.05 g/m$^2$ per each side using a size press apparatus, followed by machine calendering treatment, to prepare treated base paper 9 having a basis weight of 100 g/m$^2$.

<Treated Base Paper 10>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and calcium nitrate in an amount of 5.5 g/m$^2$ per each side using a size press apparatus, followed by machine calendering treatment, to prepare treated base paper 10 having a basis weight of 100 g/m$^2$.

<Treated Base Paper 11>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and sodium chloride in an amount of 3.0 g/m$^2$ per each side using a size press apparatus, followed by machine calendering treatment, to prepare treated base paper 11 having a basis weight of 100 g/m$^2$.

<Treated Base Paper 12>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper were applied starch phosphate in an amount of 3.0 g/m$^2$ per each side and an anionic acrylic resin (VONCOAT AN-680, manufactured by DIC Corporation) in an amount of 3.0 g/m$^2$ per each side using a size press apparatus, followed by machine calendering treatment, to prepare treated base paper 12 having a basis weight of 100 g/m$^2$.

<Treated Base Paper 13>

To a pulp slurry comprising 100 parts of LBKP having a freeness of 400 ml csf were added 12 parts of precipitated calcium carbonate as a filler, 0.8 part of amphoteric starch, 0.8 part of aluminum sulfate, and 1.0 part of an alkyl ketene dimer sizing agent (Sizepine K903, manufactured by Arakawa Chemical Industries, Ltd.), and the resultant slurry was subjected to paper making using a fourdrinier paper machine, and to the resultant paper was applied starch phosphate in an amount of 3.0 g/m$^2$ per each side using a size press apparatus, followed by machine calendering treatment, to prepare treated base paper 13 having a basis weight of 100 g/m$^2$.

(Preparation of Ground Calcium Carbonate)

<Ground Calcium Carbonate 1>

Using a jaw crusher, a hammer crusher, and a roller mill, natural limestone was granulated so that the resultant particles had an average particle diameter of about 30 μm, and to the resultant particles were added water, and a commercially available polyacrylic acid dispersant in an amount of 1.5 part by mass in terms of the solids content, relative to 100 parts by mass of the ground calcium carbonate, and the resultant mixture was stirred to obtain an about 75% pre-dispersed slurry. The pre-dispersed slurry was treated using a wet milling machine, manufactured by Ashizawa Finetech Ltd. (horizontal, cylindrical milling chamber having a size of: diameter: about 0.5 m; length: about 1.3 m). Conditions for the treatment were such that beads made of zirconia having a diameter of about 0.2 mm were used, the packing ratio was 83% by volume, the flow rate was about 15 liter/minute, and the pass frequency was 16. The obtained ground calcium carbonate had an average particle diameter of 0.20 μm. Further, the slurry concentration was 55%.

<Ground Calcium Carbonate 2>

Using a jaw crusher, a hammer crusher, and a roller mill, natural limestone was granulated so that the resultant particles had an average particle diameter of about 30 μm, and to the resultant particles were added water, and a commercially available polyacrylic acid dispersant in an amount of 1.5 part by mass in terms of the solids content, relative to 100 parts by mass of the ground calcium carbonate, and the resultant mixture was stirred to obtain an about 75% pre-dispersed slurry. The pre-dispersed slurry was treated using a wet milling machine, manufactured by Ashizawa Finetech Ltd. (horizontal, cylindrical milling chamber having a size of: diameter: about 0.5 m; length: about 1.3 m). Conditions for the treatment were such that beads made of zirconia having a diameter of about 0.2 mm were used, the packing ratio was 83% by volume, the flow rate was about 15 liter/minute, and the pass frequency was 24. The obtained ground calcium carbonate had an average particle diameter of 0.12 μm. Further, the slurry concentration was 52%.

<Ground Calcium Carbonate 3>

Using a jaw crusher, a hammer crusher, and a roller mill, natural limestone was granulated so that the resultant particles had an average particle diameter of about 30 μm, and to the resultant particles were added water, and a commercially available polyacrylic acid dispersant in an amount of 1.5 part by mass in terms of the solids content, relative to 100 parts by mass of the ground calcium carbonate, and the resultant mixture was stirred to obtain an about 75% pre-dispersed slurry. The pre-dispersed slurry was treated using a wet milling machine, manufactured by Ashizawa Finetech Ltd. (horizontal, cylindrical milling chamber having a size of: diameter: about 0.5 m; length: about 1.3 m). Conditions for the treatment were such that beads made of zirconia having a diameter of about 0.2 mm were used, the packing ratio was 83% by volume, the flow rate was about 15 liter/minute, and the pass frequency was 12. The obtained ground calcium carbonate had an average particle diameter of 0.28 μm. Further, the slurry concentration was 55%.

<Ground Calcium Carbonate 4>

Using a jaw crusher, a hammer crusher, and a roller mill, natural limestone was granulated so that the resultant particles had an average particle diameter of about 30 μm, and to the resultant particles were added water, and a commercially available polyacrylic acid dispersant in an amount of 1.5 part by mass in terms of the solids content, relative to 100 parts by mass of the ground calcium carbonate, and the resultant mixture was stirred to obtain an about 75% pre-dispersed slurry. The pre-dispersed slurry was treated using a wet milling machine, manufactured by Ashizawa Finetech Ltd. (horizontal, cylindrical milling chamber having a size of: diameter: about 0.5 m; length: about 1.3 m). Conditions for the treatment were such that beads made of zirconia having a diameter of about 0.2 mm were used, the packing ratio was 83% by volume, the flow rate was about 15 liter/minute, and the pass frequency was 34. The obtained ground calcium carbonate had an average particle diameter of 0.07 μm. Further, the slurry concentration was 50%.

<Ground Calcium Carbonate 5>

Using a jaw crusher, a hammer crusher, and a roller mill, natural limestone was granulated so that the resultant particles had an average particle diameter of about 30 μm, and to the resultant particles were added water, and a commercially available polyacrylic acid dispersant in an amount of 1.5 part by mass in terms of the solids content, relative to 100 parts by mass of the ground calcium carbonate, and the resultant mixture was stirred to obtain an about 75% pre-dispersed slurry. The pre-dispersed slurry was treated using a wet milling machine, manufactured by Ashizawa Finetech Ltd. (horizontal, cylindrical milling chamber having a size of: diameter: about 0.5 m; length: about 1.3 m). Conditions for the treatment were such that beads made of zirconia having a diameter of about 0.2 mm were used, the packing ratio was 83% by volume, the flow rate was about 15 liter/minute, and the pass frequency was 8. The obtained ground calcium carbonate had an average particle diameter of 0.40 μm. Further, the slurry concentration was 60%.

<Measurement of the Average Particle Diameter of Ground Calcium Carbonate>

With respect to the above-obtained ground calcium carbonate, an average particle diameter was determined by the following method. A particle size distribution of the ground calcium carbonate incorporated into the coating layer was measured using a particle size distribution measurement apparatus, Microtrac MT3300EXII, manufactured by Nikkiso Co., Ltd., under the measurement conditions shown below.

| | |
|---|---|
| Solvent | Water |
| Refractive index of the particle | 1.65 |
| Particle shape | Non-spherical |

From the results of the particle size distribution, a particle size distribution curve, in terms of the volume, relating to the particle diameter of the pigment was prepared, and an average particle diameter was determined by calculation using analysis means attached to the measurement apparatus.

<Preparation of a Coating Composition for Coating Layer>

A coating composition for coating layer having the ingredients shown below was prepared.

| Pigment | Type and amount incorporated are shown in Table 1. |
|---|---|
| Styrene-butadiene copolymer latex (JSR-2605G, manufactured by JSR Corporation) | 10 Parts |
| Starch phosphate (MS#4600, manufactured by Nihon Shokuhin Kako Co., Ltd.) | 10 Parts |

The ingredients having the above formulation were mixed and dispersed in water to prepare a composition having a concentration of 48%.

TABLE 1

| | | Pigment | | | | | | | Evaluation |
|---|---|---|---|---|---|---|---|---|---|
| | Type of base paper | Type of ground calcium carbonate | Amount (Parts by mass) | Other pigment | Amount (Parts by mass) | Evaluation of offset printability | Evaluation of mottling | Evaluation of print density | of rubbing resistance with respect to printed area |
| Example 1 | Base paper 1 | Ground calcium carbonate 1 | 100 | None | 0 | 4 | 4 | 5 | 5 |
| Example 2 | Base paper 1 | Ground calcium carbonate 2 | 100 | None | 0 | 4 | 4 | 5 | 5 |
| Example 3 | Base paper 1 | Ground calcium carbonate 3 | 100 | None | 0 | 4 | 4 | 4 | 5 |
| Example 4 | Base paper 2 | Ground calcium carbonate 1 | 100 | None | 0 | 5 | 3 | 4 | 4 |
| Example 5 | Base paper 3 | Ground calcium carbonate 1 | 100 | None | 0 | 4 | 4 | 5 | 5 |
| Example 6 | Base paper 1 | Ground calcium carbonate 1 | 60 | Kaolin A | 40 | 3 | 3 | 3 | 3 |
| Example 7 | Base paper 1 | Ground calcium carbonate 1 | 80 | Kaolin A | 20 | 4 | 4 | 4 | 4 |
| Example 8 | Base paper 1 | Ground calcium carbonate 1 | 60 | Precipitated calcium carbonate A | 40 | 4 | 3 | 3 | 3 |
| Example 9 | Base paper 6 | Ground calcium carbonate 1 | 100 | None | 0 | 5 | 5 | 5 | 5 |
| Example 10 | Base paper 7 | Ground calcium carbonate 1 | 100 | None | 0 | 5 | 3 | 4 | 5 |
| Example 11 | Base paper 8 | Ground calcium carbonate 1 | 100 | None | 0 | 5 | 4 | 5 | 5 |

TABLE 1-continued

| | Type of base paper | Pigment: Type of ground calcium carbonate | Pigment: Amount (Parts by mass) | Pigment: Other pigment | Pigment: Amount (Parts by mass) | Evaluation of offset printability | Evaluation of mottling | Evaluation of print density | Evaluation of rubbing resistance with respect to printed area |
|---|---|---|---|---|---|---|---|---|---|
| Example 12 | Base paper 6 | Ground calcium carbonate 2 | 100 | None | 0 | 5 | 4 | 5 | 5 |
| Example 13 | Base paper 6 | Ground calcium carbonate 3 | 100 | None | 0 | 5 | 5 | 4 | 5 |
| Example 14 | Base paper 6 | Ground calcium carbonate 1 | 60 | Kaolin A | 40 | 4 | 3 | 3 | 3 |
| Example 15 | Base paper 6 | Ground calcium carbonate 1 | 60 | Precipitated calcium carbonate A | 40 | 4 | 4 | 3 | 3 |
| Comparative Example 1 | Base paper 13 | Ground calcium carbonate 1 | 100 | None | 0 | 5 | 1 | 1 | 2 |
| Comparative Example 2 | Base paper 4 | Ground calcium carbonate 1 | 100 | None | 0 | 5 | 1 | 2 | 2 |
| Comparative Example 3 | Base paper 5 | Ground calcium carbonate 1 | 100 | None | 0 | 3 | 2 | 3 | 3 |
| Comparative Example 4 | Base paper 1 | Ground calcium carbonate 4 | 100 | None | 0 | 3 | 2 | 4 | 3 |
| Comparative Example 5 | Base paper 1 | Ground calcium carbonate 5 | 100 | None | 0 | 4 | 1 | 2 | 2 |
| Comparative Example 6 | Base paper 1 | Ground calcium carbonate 1 | 50 | Kaolin A | 50 | 3 | 1 | 2 | 2 |
| Comparative Example 7 | Base paper 1 | — | 0 | Kaolin B | 100 | 1 | 1 | 1 | 1 |
| Comparative Example 8 | Base paper 11 | Ground calcium carbonate 1 | 100 | None | 0 | 3 | 1 | 2 | 2 |
| Comparative Example 9 | Base paper 12 | Ground calcium carbonate 1 | 100 | None | 0 | 5 | 1 | 1 | 2 |
| Comparative Example 10 | Base paper 6 | Ground calcium carbonate 4 | 100 | None | 0 | 3 | 2 | 4 | 3 |
| Comparative Example 11 | Base paper 6 | Ground calcium carbonate 5 | 100 | None | 0 | 4 | 2 | 2 | 3 |
| Comparative Example 12 | Base paper 9 | Ground calcium carbonate 1 | 100 | None | 0 | 5 | 2 | 2 | 2 |
| Comparative Example 13 | Base paper 10 | Ground calcium carbonate 1 | 100 | None | 0 | 3 | 2 | 3 | 2 |
| Comparative Example 14 | Base paper 6 | Ground calcium carbonate 1 | 50 | Kaolin A | 50 | 3 | 2 | 2 | 2 |
| Comparative Example 15 | Base paper 6 | — | 0 | Kaolin B | 100 | 2 | 1 | 1 | 1 |
| Comparative Example 16 | Base paper 1 | — | 0 | Precipitated calcium carbonate B | 100 | 3 | 3 | 5 | 1 |

The other pigments shown in Table 1 are as follows.

Precipitated calcium carbonate A (TP123, manufactured by Okutama Kogyo Co., Ltd.; average particle diameter: 0.63 μm)

Precipitated calcium carbonate B (Brilliant-15, manufactured by Shiraishi Calcium Kaisha, Ltd.; average particle diameter: 0.15 μm)

Kaolin A (HG90, manufactured by KaMin LLC; average particle diameter: 0.19 μm)

Kaolin B (KAOFINE 90, manufactured by Shiraishi Calcium Kaisha, Ltd.; average particle diameter: 1.1 μm)

Printing coated papers in Examples and Comparative Examples were individually prepared by the following procedure.

<Preparation of a Printing Coated Paper>

The coating composition for coating layer was applied to both sides of the treated base paper using a blade coater, and dried, and then subjected to calendering treatment to prepare a printing coated paper. The coating weight per each side was 10 g/m$^2$.

(Evaluation of Offset Printability)

Using, as an offset printing machine, an offset form rotary press, manufactured by Miyakoshi Printing Machinery Co., Ltd., printing was performed for 6,000 m under conditions such that the printing speed was 150 m/minute, T&K TOKA UV BEST CURE black and bronze-red were used as inks, and two UV irradiation sources at 8 kW were used. After the printing, the occurrence of blanket piling and the state of the printed sample were visually evaluated. The ratings "3" through "5" indicate that there is no problem from a practical point of view.

5: Very excellent.

4: Excellent.

3: There is no problem from a practical point of view.

2: Bad.

1: Very bad.

(Evaluation of Mottling)

Using, as an ink-jet printing machine, printing machine Prosper 5000XL, manufactured by Eastman Kodak Company (ink: pigment ink; printing speed: 75 m/minute), solid printing was performed by a method in which solid patterns, 3 cm×3 cm square, of 7 colors in total are recorded on a printing coated paper by the printing machine wherein the patterns are arranged in a horizontal line, and the 7 colors include black, cyan, magenta, yellow, and blended colors (red, green, and blue) of 2 colors among the above 3-color inks, excluding the black ink. With respect to the solid printed image area of each color, the occurrence of mottling (mark of extremely small spots) was visually evaluated. In the present invention, the ratings "3" through "5" indicate that the occurrence of mottling can be suppressed.

5: Mottling is satisfactorily suppressed.

4: Extremely slight mottling is recognized.

3: Slight mottling is recognized. There is no problem from a practical point of view.

2: Partial mottling is recognized.

1: Definite mottling is recognized.

(Evaluation of Print Density)

Using, as an ink jet printing machine, printing machine Truepress Jet520, manufactured by Dainippon Screen Mfg. Co., Ltd. (ink: dye ink; printing speed: 72 m/minute), solid printing was performed by a method in which solid patterns, 2 cm×2 cm square, of 7 colors in total are recorded on a printing coated paper by the printing machine wherein the patterns are arranged in a horizontal line, and the 7 colors include black, cyan, magenta, yellow, and blended colors (red, green, and blue) of 2 colors among the above 3-color inks, excluding the black ink. With respect to the solid printed image area of each color, the print density was visually evaluated from the viewpoint of the color density and color brightness. In the present invention, the ratings "3" through "5" indicate that the print density of a dye ink is excellent.

5: Both the color density and color brightness are excellent.

4: Any one of the color density and color brightness is poorer than "5" but excellent.

3: The color density and color brightness are at a level having no problem from a practical point of view.

2: Any one of the color density and color brightness is poorer than "3" and has a problem from a practical point of view.

1: Both the color density and color brightness are poor and have a problem from a practical point of view.

(Evaluation of Rubbing Resistance with Respect to the Printed Area)

Using, as an ink-jet printing machine, printing machine Prosper 5000XL, manufactured by Eastman Kodak Company (ink: pigment ink; printing speed: 75 m/minute), a solid image having a size of 18 cm×18 cm was printed with a black ink on a printing coated paper by the printing machine. After a lapse of one hour from the printing, an abrasion test was performed 25 times in which cotton gauze was pressed against the printed surface of the printing coated paper at a load of 500 g or 300 g so that the pressed area was 4 $cm^2$. The state of a scuff caused in the printed area was visually evaluated. In the present invention, the ratings "3" through "5" indicate that the nabbing resistance with respect to the printed area is excellent.

5: At 500 g, almost no scuff is recognized.

4: At 500 g, a slight scuff is recognized, which is an acceptable level.

3: At 300 g, a slight scuff is recognized, which is an acceptable level.

2: At 300 g, a scuff is recognized.

1: At 300 g, a marked scuff is recognized.

With respect to the printing coated papers in Examples and Comparative Examples, the results of the evaluation of offset printability and the evaluation of the mottling, print density, and rubbing resistance with respect to the printed area in ink-jet printing are shown in Table 1.

From Table 1, it is found that the printing coated papers in Examples 1 to 15, which correspond to the printing coated paper of the present invention, have offset printability and, in ink-jet printing, can suppress the occurrence of mottling and exhibit excellent rubbing resistance with respect to the printed area and excellent print density of a dye ink, and can produce a printed material having excellent image quality. On the other hand, from Table 1, it is found that, in Comparative Examples 1 to 16, each of which does not satisfy the requirements of the present invention, any of the effects of the present invention are not achieved.

As is apparent from the results of ink-jet printing performed using the printing coated papers in Examples 1 to 15, by the method for producing a printed material of the present invention, there can be produced a printed material advantageous not only in that the occurrence of mottling is suppressed, but also in that the print density of a dye ink and the rubbing resistance with respect to the printed area are excellent.

The invention claimed is:

1. A printing coated paper comprising a base paper and a coating layer, wherein the coating layer is formed on at least one side of the base paper, and consists essentially of a pigment and a binder, wherein the base paper is a treated base paper to which a treatment solution containing at least one member selected from a cationic resin and a water-soluble multivalent cation salt has been applied by size press, wherein the total applied amount of the at least one member selected from a cationic resin and a water-soluble multivalent cation salt per each side of the base paper, in terms of the solids content, is in the range of from 0.1 to 5.0 $g/m^2$, and wherein at least one of the pigment in the coating layer is ground calcium carbonate treated with an organic dispersant and having an average particle diameter based on volume of 0.1 to 0.28 μm, wherein the amount of the ground calcium carbonate having an average particle diameter based on volume of 0.1 to 0.28 μm contained in the coating layer is in the range of 60 parts by mass or more, relative to 100 parts by mass of the total of the pigment(s) in the coating layer.

2. A printing coated paper comprising a base paper and a coating layer, wherein the coating layer is formed on at least one side of the base paper, and consists essentially of a pigment and a binder, wherein the base paper is a treated base paper to which a treatment solution containing calcium nitrate that has been applied by size press, wherein the total applied amount of calcium nitrate per each side of the base paper, in terms of the solids content, is in the range of from 0.1 to 5.0 $g/m^2$, and wherein at least one of the pigment in the coating layer is ground calcium carbonate treated with an organic dispersant and having an average particle diameter based on volume of 0.1 to 0.28 μm, wherein the amount of the ground calcium carbonate having an average particle diameter based on volume of 0.1 to 0.28 μm contained in the coating layer is in the range of 60 parts by mass or more, relative to 100 parts by mass of the total of the pigment(s) in the coating layer.

* * * * *